United States Patent [19]

Selvin

[11] 3,994,552

[45] Nov. 30, 1976

[54] SUBMERSIBLE PIPE ELECTRICAL CABLE ASSEMBLY

[75] Inventor: Gerald J. Selvin, Huntington Beach, Calif.

[73] Assignee: International Telephone and Telegraph Corporation, New York, N.Y.

[22] Filed: Oct. 1, 1975

[21] Appl. No.: 618,345

[52] U.S. Cl. ..... 339/49 B; 339/61 M

[51] Int. Cl.[2] ..... H01R 13/52

[58] Field of Search ..... 339/45, 48, 49, 61 R, 339/61 C, 61 M, 64, 94, 255 R, 89 M, 49 B

[56] References Cited

UNITED STATES PATENTS

| | | | |
|---|---|---|---|
| 3,017,597 | 1/1962 | Nava et al. | 339/94 M X |
| 3,091,750 | 5/1963 | Long et al. | 339/94 M X |
| 3,209,305 | 9/1965 | Bruckner et al. | 339/61 C |
| 3,441,898 | 4/1969 | Nodfelt | 339/48 |
| 3,657,681 | 4/1972 | Falkner | 339/61 M |
| 3,784,959 | 1/1974 | Horton | 339/61 M |
| 3,808,577 | 4/1974 | Mathauser | 339/48 |

*Primary Examiner*—Gerald A. Dost
*Attorney, Agent, or Firm*—Thomas L. Peterson

[57] ABSTRACT

A submersible pipe electrical connector assembly in which mating electrical connector members are mounted in the ends of first and second pipe sections which are coupled together by a rotatable threaded coupling sleeve to interengage the connector members. Each connector member has one or more annular contacts therein concentric to the longitudinal axis of its respective pipe section. The contacts have the same diameter and engage each other in axial abutting relationship when the coupling sleeve couples the pipe sections together. One of the connector members has a resilient body with its annular contact mounted on the front face of the body. A cylindrical bellows is embedded in the resilient body concentric with the contact. The bellows is connected at its front to the contact and at its rear to a conductor termination element.

2 Claims, 6 Drawing Figures

SUBMERSIBLE PIPE ELECTRICAL CABLE ASSEMBLY

CROSS-REFERENCE TO RELATED APPLICATIONS

The invention in this application is a modification of and, in some respects, is an improvement upon the inventions disclosed in copending application of George J. Panek et al., entitled, "Submersible Pipe Electrical Cable Assembly", Ser. No. 574,405, filed May 5, 1975, and copending application of L. W. Oliver, also entitled "Submersible Pipe Electrical Cable Assembly", Ser. No. 574,404, filed May 5, 1975, both assigned to the assignee of the present application.

BACKGROUND OF THE INVENTION

This invention relates generally to an electrical cable assembly and, more particularly, to such an assembly incorporated in a segmented submersible pipe.

Power cables are utilized to interconnect surface power or instrumentation with motor-pump assemblies or other electrical devices used in submersible water-oil-gas well pumping operations. It is conventional practice to clamp the power cable to the down hole delivery tubing for support to interconnect the surface power to the submersible pump. The power cable is handled by means of a power operated hoist and reel on the surface. This method provides insufficient protection from abrasion, pinching or cutting of the cable insulation as the cable and pump delivery tubing are installed in a well casing. These shortcomings become very acute as the well casing bends and varies from its vertical orientation. Also, protection of the power cable from the environment of the well casing is nonexistent. This environment may include dirt, rocks, debris, water, oil, gas, shock, vibration and high temperatures.

As described in the aforementioned copendig Panek et al application, the above-discussed disadvantages in the present method of interconnecting the power cable to a submersible motor driven pump may be overcome by mounting the cable and electrical interfacing components within segmented pipe sections to completely protect the components from abrasion, vibration, and the surrounding environment. More specifically, a pair of mating electrical connector members are mounted in the ends of the pipe sections. Each electrical connector member has at least one annular contact therein which is concentric to the longitudinal axis of its respective pipe. The contacts are dimensioned to slidably engage with each other when the pipes are coupled together in axial alignment. A conventional pipe coupling sleeve is threaded to the ends of the pipes to couple them together thereby mating the electrical connector members in the ends of the pipes and hence electrically interengaging the annular contacts therein. Because the contacts have an annular configuration, the pipes may be connected together using standard pipe joining components and methods. This in contrast to conventional pin and socket electrical connector members which are normally interengged by exerting relative axial movement, but no rotatable movement, toward each other by the use of a separate rotatable coupling nut which is mounted on the shell of one of the connector members.

In one of the embodiments disclosed in the aforementioned Panek et al application, the annular contacts in the mating connector members have approximately the same diameter and have front surfaces which are flush with the front faces of the connector insulators in which the contacts are mounted. Thus, when the connector members are interengaged, the annular contacts will engage each other in an axial abutting relationship. Good electrical contact is not always achieved by this butt contact arrangement due to differences in axial tolerances across the mating faces of the electrical connector members. The connctor disclosed in the aforementioned Oliver application overcomes this problem by providing a novel axially compressible annular spring contact in one of the mating connector members. In the preferred embodiment, the contact comprises a helically coiled spring formed as an annulus. The present invention overcomes the axial tolerance problem in a more inexpensive, versatile and trouble-free manner.

SUMMARY OF THE INVENTION

According to the principal aspect of the present invention, a butt contact connector assembly as disclosed in the aforementioned Panek et al and Oliver applications is modified by mounting the annular contact in one of the connector members of the assembly on the front of an axially deformable resilient insulation body in which a cylindrical metal bellows is embedded. The front of the bellows is connected to the contact and the rear of the bellows is connected to a conductor termination element, providing electrical connection therebetween. Since the resilient body is axially compressible, it will accommodate any differences in tolerances across the mating faces of the electrical connector members in the assembly. Thus, good electrical contact is assured regardless of failure to maintain manufacturing tolerances. Further, the connector members may be made in one-piece form which simplifies original assembly and maintenance of the cable assembly in the field.

DESCRIPTION OF THE PREFERRED EMBODIMENTS

Reference is now made to FIGS. 1–4 of the drawings in detail, which illustrate the submersible pipe electrical cable assembly of the present invention, generally designated 10. The assembly includes two elongated tubular members 12 and 14 and a coupling sleeve 16.

Figure 4:
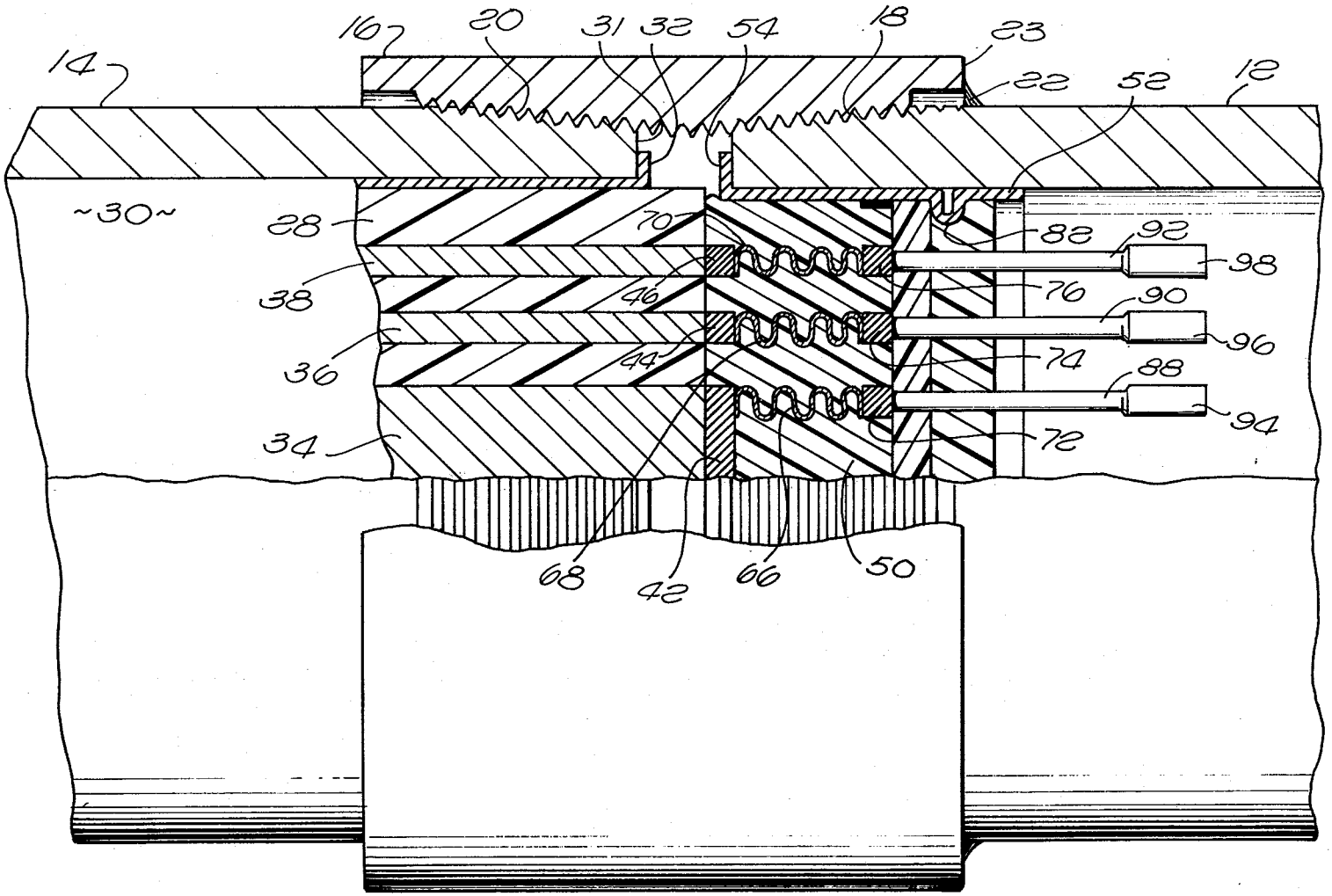
FIG. 4 is a longitudinal sectional view similar to FIG. 1 but showing the connector members fully interengaged.

The tubular members preferably consist of standard threaded pipe lengths which have tapered threaded ends, as indicated at 18 and 20. The coupling sleeve 16 is preferably a standard pipe joint which is internally threaded. The sleeve is threaded to the ends 18 and 20 to couple the pipe sections 12 and 14 in axial alignment. The coupling sleeve 16 may be permanently secured to one of the pipe sections, preferably the pipe 12, as indicated by the weld joint at 22 at the end 23 of the sleeve. Mating electrical connector members 24 and 26 are fixedly mounted in the ends of the pipes 14 and 12, respectively. The connector members are electrically connected together when the pipe sections 12 and 14 are coupled together by the coupling sleeve 16, as seen in FIG. 4.

The connector member 24 comprises an insulation body 28 surrounded by a formed metal housing 30. The forward end of the housing 30 is bent outwardly at its end to form an annular flange 32. The flange 32 is welded or otherwise affixed to the end 31 of pipe 14 to fixedly retain the housing within the end of the pipe. The insulation body 28 is fixedly mounted within the housing 30.

A solid center conductor 34 and two outer cylindrical conductors 36 and 38 are mounted in the insulation body 28. The center conductor is coaxial with the longitudinal axis of the tubular housing 30 and the longitudinal axis of the pipe 14. The cylindrical conductor 36 is concentric to and spaced from the center conductor 34 while the outer cylindrical conductor 38 is spaced from the cylindrical conductor 36 and likewise is concentric with respect to the center conductor. The insulation body 28 electrically isolates the center conductor from the cylindrical conductor 36, the two cylindrical conductors 36 and 38 from each other, and the outer cylindrical conductor 38 from the housing 30. Preferably, the insulation body 28 is an integral molded plastic piece in which the conductors are embedded and thus fixed against axial movement in the body. Further, the conductors are axially rigid so that they will not deform when axial force is applied thereto. The rear ends of the conductors are connected to wires of a cable, not shown, extending through the pipe 14.

The insulation body 28 and the conductors therein extend outwardly beyond the forward end of the housing 30. The flat front surfaces of the contacts are flush with the flat front face 40 of the insulation body. The flat face 40 extends transverse to the longitudinal axis of th pipe 14.

The connector member 26 is similar to the connector member 24 in that it contains a solid center contact 42, in the form of a flat circular disc, and annular concentric outer spaced contacts or rings 44 and 46 all mounted on the front face 48 of an insulation body 50. The front face 48 is flat and transverse to the longitudinal axis of the pipe 12. The contacts 42, 44, and 46 have the same diameters as the contacts 34, 36, and 38 in connector member 24, and are concentric therewith. A cylindrical, formed metal housing 52 surrounds the insulation body 50. The housing has an annular forward flange 54 welded to the forward end 56 of the pipe 12. The front face 48 of the insulation body 50 extends beyond the flange 54 on the connector housing 52 so that the contacts 42, 44, and 46 thereon are in position to engage the contacts 34, 36 and 38 in the mating connector member 24 when the pipe sections 12 and 14 are coupled together by the coupling sleeve 16.

The insulation body 50 in the connector member 26 is in the form of an axially deformable resilient insulator, such as a suitable elastomer. Integral annular sealing rings 60, 62 and 64 extend forwardly from the front face 48 of the resilient body 50 and beyond the front faces of the contacts therein. The sealing ring 60 is disposed between the contacts 42 and 44, the sealing ring 62 is diposed between the contacts 44 and 46, and the sealing ring 64 surrounds the outer contact 46. The sealing rings axially deform when the connector members 24 and 26 are mated together.

Three cylindrical, concentric metal bellows 66, 68 and 70 are embedded in the resilient body 50. The bellows 66, 68 and 70 are concentric with the contacts 42, 44 and 46, respectively. The front end of each bellows is connected to its corresponding contact. The rear end of each bellows is connected to a corresponding current distribution ring, indicated at 72, 74 and 76. The distribution rings are embedded in the resilient body 50 in front of the rear face 78 of the body. Thus, the metal bellows provide an electrical connection between the contacts 42, 44 and 46 and the distribution rings 72, 74 and 76, respectively. The bellows may be connected to the contacts and rings by soldering or brazing. The bellows may be a conventional steel bellows electroplated with copper to enhance the electrical conductivity properties of the bellows. A rigid insulation disc 80 is mounted against the rear face 78 of the resilient body 50. An inwardly extending annular flange 82 on the housing 52 engages the rear 84 of the dic 80 thereby limiting rearward movement of the disc, and hence the resilient body 50, in the connector 52. Preferably an elastomer sealing grommet 86 is bonded to the rear 84 of the insulation disc 80. Wire termination elements 88, 90 and 92 are connected to the distribution rings 72, 74 and 76, respectively. The termination elements extend through the disc 80 and sealing grommet 86 in sealing relationship with the grommet. The elements terminate in crimp or solder pots, indicated at 94, 96 and 98 which are joined to wires in the cable, not shown, extending through the pipe 12.

It is noted that the outer periphery 100 of the resilient body 50 is spaced a slight distance from the inner periphery of the cylindrical housing 52 so that the body is axially compressible within the housing when an axial force is applied to the front face of the body. Preferably the rear portion of the body 50 is bonded to the interior of the housing 52 by means of a suitable cement, as indicated at 102. A plurality of integral axially spaced annular sealing ribs 104 are formed on the outer periphery 100 of the resilient body 50 in sealing engagement with the interior of the housing 52. Thus, the sealing ribs will prevent the intrusion of any moisture or dust into the interior of the connector member, yet will permit axial compression of the body within the housing. It will be appreciated that the connector member 26 constitutes a one-piece integral assembly which may be readily assembled to the pipe 12 and replaced when required in the field. While the housing 52 has been illustrated as having a generally cylindrical form, the housing could be in the form of a metal bellows, if desired, to permit greater face-to-face spacing tolerance between the front faces of the connector member 24 and 26. Alternatively, the housing 52 could be eliminated and the resilient body 50 bonded directly to the interior of the pipe 12.

To mate the connector members 26 and 24 in the pipes 12 and 14, the coupling sleeve 16 fixed to the pipe 12 is threaded onto the threaded end of the pipe 14. The use of center contacts with annular contacts in the mating connector members allows rotation between the connector members and hence the use of standard one-piece couplings with standard pipe sections, as illustrated and described herein. As a consequence, when the coupling sleeve couples the pipe sections 12 and 14 together, the front faces of the insulators in the respective connector members in the pipes abut each other, bringing the flat front surfaces of the contacts 34, 36 and 38 in the insulation body 28 into abutting engagement with the contacts 42, 44 and 46 mounted on the front of the resilient body 50. During rotational coupling of these parts, the annular sealing ribs 60, 62 and 64 on the body 50 rub against the front face 40 of the connector member 24 wiping moisture or debris away from the face to ensure electrical circuit isolation through the connector assembly. As the coupling of the pipe sections proceeds, the front face 40 of the insulation body 28 axially compresses the sealing ribs 42, 44 and 46. The axial abutment between the ends of the insulation bodies in the connector members, as well as the relative rotation of one body with respect to the other, produces good electrical interengagement between the aligned contacts in the two connector members. When the coupling sleeve 16 fully couples the pipes 12 and 14 together, as seen in FIG. 4, the resilient body 50 is axially compressed as are the bellows therein. The compressed body 50 assures that an axial compressive force is continuously applied to the contacts 42, 44 and 46 to maintain good electrical contact with the mating contacts in the connector member 24 after the pipe sections have been coupled together.

While the connector member 24 in the pipe 14 employed in the assembly 10 illustrated in FIGS. 1–4 has been described as containing fixed contacts in a rigid insulator 28, it will be appreciated that the connector member 24 may be made identical to the connector member 26 in order to accommodate greater axial tolerances.

Figure 1:
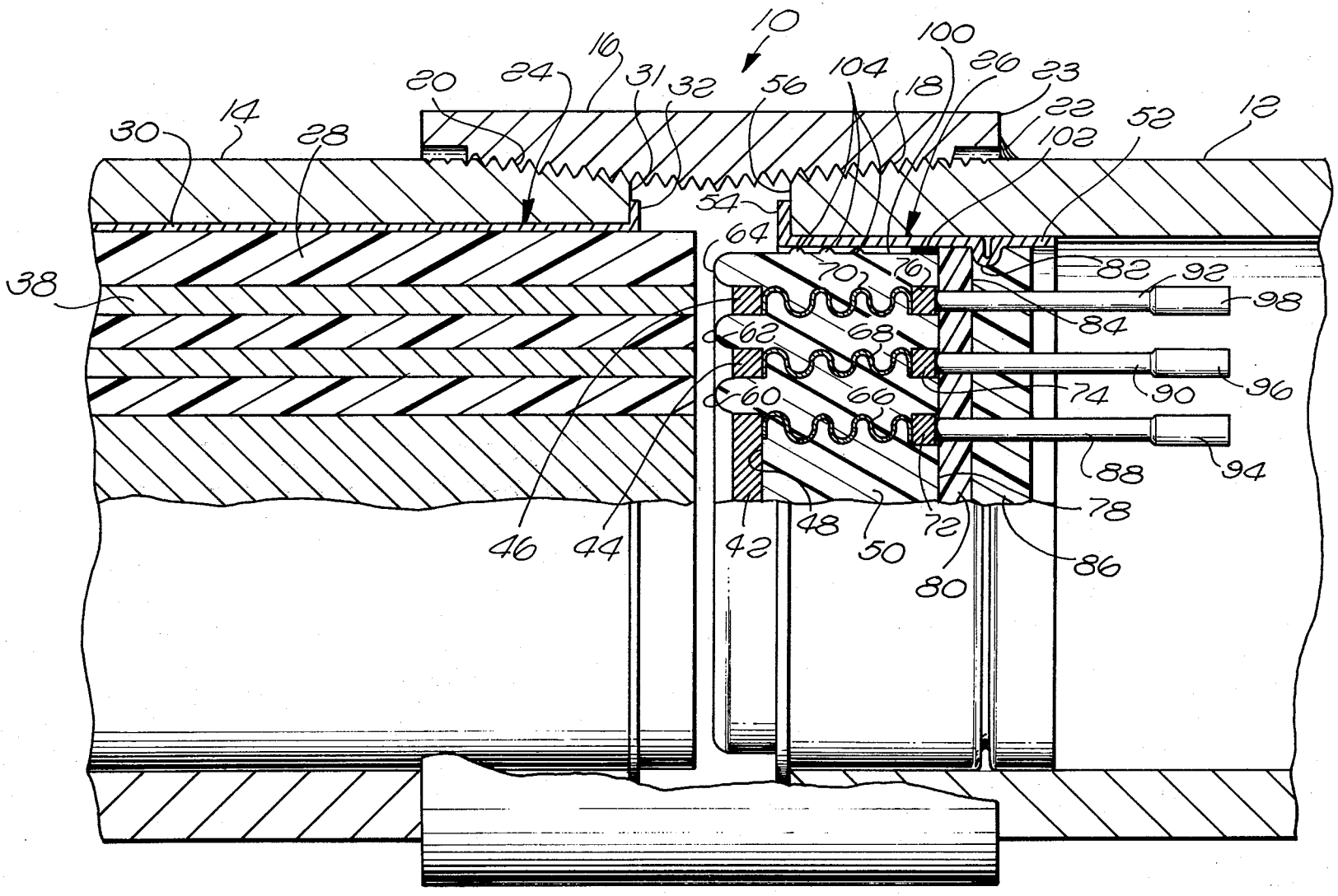
FIG. 1 is a partial longitudinal sectional view through the submersible pipe electrical cable assembly of the present invention, illustrating the opposed mating ends of the two pipe sections partially couple together with the contacts in the connectors therein not yet engaged.
Figure 2:
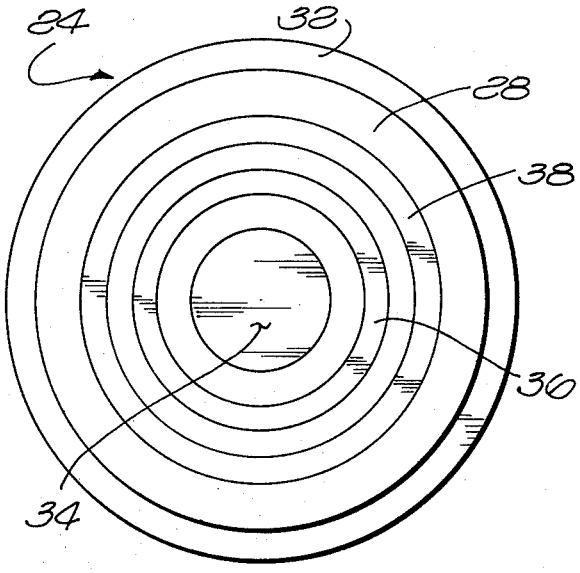
FIG. 2 is an elevational view of the end of the connector member mounted in the left pipe section illustrated in FIG. 1.
Figure 3:
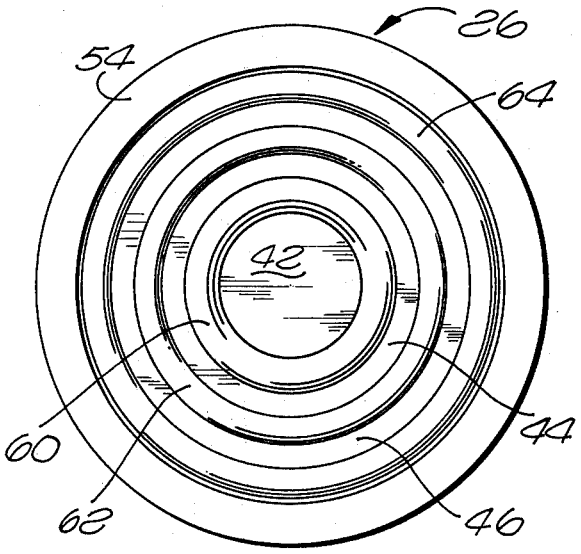
FIG. 3 is an elevational view of the end of the electrical connector member mounted in the right pipe section illustrated in FIG. 1.
Figure 5:
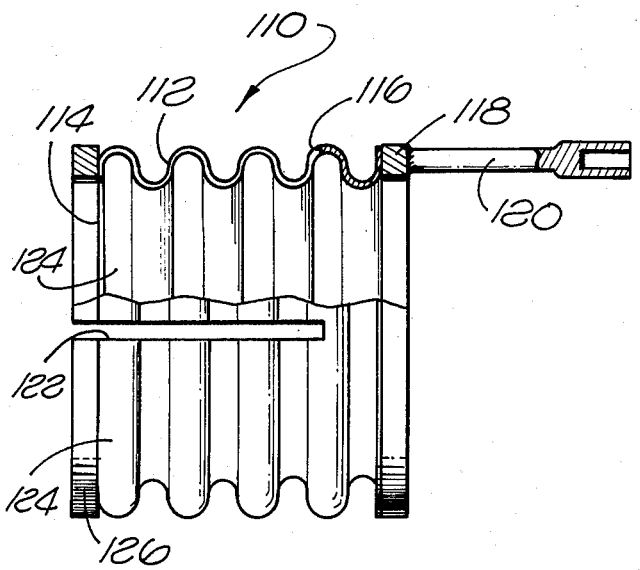
FIG. 5 is a partial longitudinal section through a modified bellows-contact assembly which may be utilized in the pipe assembly illustrated in FIGS. 1–4.
Figure 6:
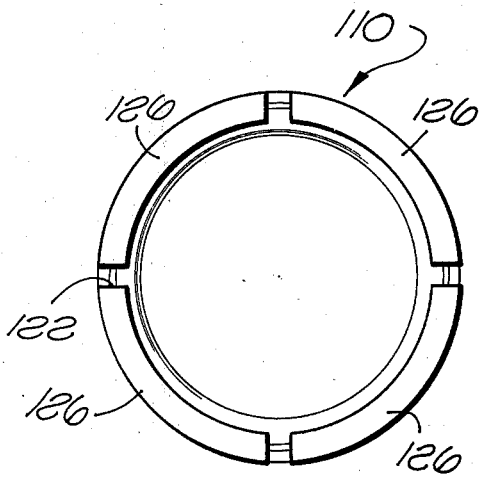
FIG. 6 is a front elevational view of the bellows-contact assembly illustrated in FIG. 5.

Reference is now to FIGS. 5 and 6 of the drawings which illustrate a modified form of a bellows-contact arrangement which may be employed in the connector member 26 described previously herein. The bellows-contact subassembly, designated 110, comprises a cylindrical metal bellows 112 which is slotted longitudinally from its front face 114 rearwrdly to a point 116 spaced in front of a distribution ring 118. A termination element 120 is connected to the distribution ring 118 as in the connector member 26. Four such slots 122 are illustrated in FIG. 5. Obviously, any number exceeding one could be utilized to achieve the desired affect. The slots divide the forward portion of the bellows into individual arcuate segments 124 which are circumferentially spaced from each other. In this embodiment, the contact for the bellows comprises four arcuate segments 126 joined to the forward ends of the arcuate bellows segments 124. This segmented bellows and contact arrangement provides contact float and better contact surface alignment with lower bellows deflection forces. A plurality of bellows-contact assemblies 110 may be concentrically mounted in the insulation body 50 of the connector member 26.

In order to enhance the electrical conductivity of the bellows in either of the embodiments disclosed herein, the convolutions of each bellows may be packed with a metal wool prior to molding the resilient insulation body 50 around the bellows. Other modifications and variations of the invention will be apparent to those skilled in the art.

It will be appreciated from the foregoing that by the present invention improved electrical engagement may be provided between the ends of two electrical connector members having annular contacts therein which are brought into engatement with each other by relative axial and rotational movement thus assuring no failure in power being transmitted through the cable assembly.

What is claimed is:

1. A submersible pipe electrical cable assembly comprising: a pair of elongated tubular members; a rotatable coupling sleeve threaded to the ends of said tubular members to couple together and said tubular members in axial alignment; a pair of mating electrical connector members mounted in the ends of said tubular members, respectively; said connector members each having at least one annular contact therein concentric to the longitudinal axis of its respective tubular member, said contacts having approximately the same diameter and engaging each other in axial abutting relationship when said sleeve couples said tubular members together; at least one of said connector members having an axially deformably resilient insulation body with a front face transverse to said longitudinal axis and a rear face; said annular contact in said one connector member being positioned on said front face of said body; and a cylindrical metal bellows concentric with and connected to said one connector member annular contact, said bellows being embedded in said body, said one connector member having a plurality of said annular contacts on said front face of said body and a plurality of said metal bellows each concentric with and connected to a corresponding one of said contacts, and embedded in said body, said resilient body embodying forwardly projecting annular sealing rings between said contacts.

2. A submersible pipe electrical cable assembly comprising: a pair of elongated tubular members; a rotatable coupling sleeve threaded to the ends of said tubular members to couple together said tubular members in axial alignment; a pair of mating electrical connector members mounted in the ends of said tubular members, respectively; said connector members each having at least one annular contact therein concentric to the longitudinal axis of its respective tubular member, said contacts having approximately the same diameter and engaging each other in axial abutting relationship when said sleeve couples said tubular members together; at least one of said connector members having an axially deformably resilient insulation body with a front face transverse to said longitudinal axis and a rear face; said annular contact in said one connector member being positioned on said front face of said body; and a cylindrical metal bellows concentric with and connected to said one connector member annular contact, said bellows being embedded in said body, a metal housing surrounding said body in said one connector member, the outer periphery of said body adjacent to said rear face thereof being bonded to said housing, said body embodying at least one annular sealing rib on its outer periphery adjacent to said front face, said rib sealingly engaging said housing.

* * * * *